United States Patent [19]

DeBold et al.

[11] Patent Number: 4,818,484

[45] Date of Patent: Apr. 4, 1989

[54] AUSTENITIC, NON-MAGNETIC, STAINLESS STEEL ALLOY

[75] Inventors: Terry A. DeBold, Wyomissing; John H. Magee, Jr.; Norman B. Schmidt, both of Reading, all of Pa.

[73] Assignee: Carpenter Technology Corporation, Reading, Pa.

[21] Appl. No.: 935,116

[22] Filed: Nov. 26, 1986

Related U.S. Application Data

[60] Continuation of Ser. No. 772,727, Sep. 4, 1985, abandoned, which is a division of Ser. No. 560,932, Dec. 13, 1983, Pat. No. 4,554,028.

[51] Int. Cl.[4] ..... C22C 38/44

[52] U.S. Cl. ..... 420/46; 420/44; 420/45

[58] Field of Search ..... 420/44, 45, 46, 584

[56] References Cited

U.S. PATENT DOCUMENTS

| | | | |
|---|---|---|---|
| 2,256,614 | 9/1941 | Franks | 75/128 |
| 2,553,330 | 5/1951 | Post et al. | 75/122 |
| 2,671,726 | 3/1954 | Jennings | 75/128 |
| 2,724,647 | 11/1955 | Fleischmann | 75/128 |
| 3,112,195 | 11/1963 | Souresny | 75/126 |
| 3,129,120 | 4/1964 | Smith et al. | 148/327 |
| 3,201,233 | 8/1965 | Hull | 75/128 |
| 3,592,634 | 7/1971 | Denhard et al. | 75/128 A |
| 3,726,668 | 4/1973 | Bäumel | 75/125 |
| 3,854,938 | 12/1974 | Baybrook et al. | 75/128 |
| 4,007,038 | 2/1977 | Deverell | 75/122 |
| 4,078,920 | 3/1978 | Liljas et al. | 75/124 |
| 4,099,966 | 7/1978 | Chivinsky et al. | 75/125 |
| 4,302,247 | 11/1981 | Abe et al. | 420/46 |
| 4,337,088 | 6/1982 | Moses | 75/128 |
| 4,341,555 | 7/1982 | Douthett et al. | 75/128 |
| 4,371,394 | 2/1983 | Henthorne et al. | 420/46 |
| 4,421,557 | 12/1983 | Rossomme et al. | 75/125 |

FOREIGN PATENT DOCUMENTS

| | | |
|---|---|---|
| 1950932 | 2/1971 | Fed. Rep. of Germany . |
| 3637954 | 6/1982 | Fed. Rep. of Germany . |
| E91370 | 5/1968 | France . |
| E93081 | 2/1969 | France . |
| 2271296 | 12/1975 | France . |
| 2372902 | 6/1978 | France . |
| 1142582 | 2/1969 | United Kingdom . |

OTHER PUBLICATIONS

Avesta Jernverks AB, Data Sheet "Type 254 SMO Stainless Steel" (no date).

Avesta Jernverks AB, Information 8051, "Avesta Stainless Steels—Avesta 254 SMO" (no date).

Bandy et al, "Pitting Resistant Alloys in Highly Concentrated Chloride Media" *Corrosion*/82, The International Corrosion Forum Sponsored by the National Association of Corrosion Engineers, paper No. 71 (Mar. 22–26, 1982).

Brigham, "Temperature as a Crevice Corrosion Criterion", *Corrosion–Nace*, vol. 30, No. 11, pp. 396–398 (1974).

*Primary Examiner*—Deborah Yee

*Attorney, Agent, or Firm*—Edgar N. Jay; Vincent T. Pace

[57] ABSTRACT

A large, austenitic, non-magnetic, stainless steel, alloy article which has been significantly warm worked between about 1500 F. and 1650 F. but not subsequently annealed, which has a 0.2% yield strength of at least about 90 ksi, and which, when formed into a U-bend, does not undergo stress corrosion cracking within about 700 hours in boiling saturated aqueous sodium chloride containing 2 weight percent (w/o) ammonium bisulfite. The alloy of the article consists essentially of about:

| Elements | w/o |
|---|---|
| C | 0.1 Max. |
| Mn | 1–11 |
| Si | 0.6 Max. |
| Cr | 18–23 |
| Ni | 14–25 |
| Mo | 2.5–6.5 |
| Cu | 2 Max. |
| B | .01 Max. |
| N | 0.15 Min. |

$$C + N \geqq \frac{Cr + Mo + 1.5\,Si + 0.87\,Mn - Ni - 6.1}{30}$$

and the balance is essentially iron. A preferred alloy for this article contains about:

| Elements | w/o |
|---|---|
| C | .02 Max. |
| Mn | 3.0–9.0 |
| Si | 0.5 Max. |
| Cr | 18–23 |
| Ni | 15–22 |
| Mo | 2.5–6.5 |
| N | 0.20 Min. |
| 3 Mo + Cr ≧ | 29.5 |

13 Claims, No Drawings

AUSTENITIC, NON-MAGNETIC, STAINLESS STEEL ALLOY

This application is a continuation of 06/772,727, filed 9-4-85, now abandoned, which was a divisional of 06/560,932, filed 12-13-83 now U.S. Pat. No. 4,554,028.

BACKGROUND OF THE INVENTION

This invention relates to an article having a large section size (i.e., about 5 inches [about 12.7 cm] in diameter or larger) made from a warm worked, austenitic, non-magnetic (i.e., magnetic permeability is less than about 1.02), stainless steel alloy. The article has high levels of strength, particularly yield strength and fatigue strength, and high levels of corrosion resistance, particularly resistance to chloride pitting, crevice corrosion and stress corrosion cracking. These properties make the article suitable for use as oilwell drilling equipment, such as a drill collar or a housing for a measurement-while-drilling (MWD) assembly, that is exposed to drilling fluid or mud. This invention also relates to an alloy with particularly high pitting resistance that renders the alloy especially suitable for making an article such as a drill collar.

Heretofore, articles such as drill collars have been prone to fail quickly in use due to cracking caused by stress corrosion and/or corrosion fatigue. The significant chloride pitting of the drill collars has been suspected to be at least partially responsible for these cracking problems.

SUMMARY OF THE INVENTION

In accordance with this invention, an austenitic, non-magnetic, stainless steel, alloy article is provided which: (a) has a large section size; (b) has been significantly warm worked between about 1500 F. and 1650 F. (between about 815 C. and 900 C.) but not subsequently annealed (i.e., by heating at about 1900–2200 F. [about 1040–1205 C.]); (c) has a 0.2% yield strength of at least about 90 ksi (about 620 MPa); and (d) when formed into a U-bend (as described in ASTM G30-79 and shown in FIG. 5 thereof), does not undergo stress corrosion cracking (i.e., does not show visible cracks under 20× magnification) within about 700 hours in a solution that simulates the effects of drilling fluid or mud such as boiling saturated aqueous sodium chloride containing 2 weight percent (w/o) ammonium bisulfite. The broad, preferred, particularly preferred and quite particularly preferred forms of the alloy of the large, warm worked article of this invention are conveniently summarized as consisting essentially of about:

| Elements | Broad Ranges (w/o) | Preferred Ranges (w/o) |
|---|---|---|
| C | 0.1 Max. | .07 Max. |
| Mn | 1–11 | 3.0–9.0 |
| Si | 0.6 Max. | 0.5 Max. |
| Cr | 18–23 | 18–23 |
| Ni | 14–25 | 15–22 |
| Mo | 2.5–6.5 | 2.5–6.5 |
| Cu | 2 Max. | 1 Max. |
| B | .01 Max. | |
| N | 0.15 Min. | 0.20 Min. |
| 3Mo + Cr | | ≧29.5 |
| C + N | $\geqq \frac{Cr + Mo + 1.5Si + 0.87Mn - Ni - 6.1}{30}$ | $\geqq \frac{Cr + Mo + 1.5Si + 0.87Mn - Ni - 4.3}{30}$ |

| Elements | Particularly Preferred Ranges (w/o) | Quite Particularly Preferred Ranges (w/o) |
|---|---|---|
| C | .02 Max. | |
| Mn | 3.5–7.5 | 4.0–6.0 |
| Si | | |
| Cr | 19.0–22.0 | 19.5–21.0 |
| Ni | 16.0–21.0 | 17.0–20.0 |
| Mo | 4.8–6.0 | 5.0–5.6 |
| Cu | | |
| B | | |
| N | 0.25 Min. | 0.30 Min. |
| 3Mo + Cr | ≧35.0 | |
| C + N | $\geqq \frac{Cr + Mo + 1.5Si + 0.87Mn - Ni - 2.7}{30}$ | $\geqq \frac{Cr + Mo + 1.5Si + 0.87Mn - Ni - 1.4}{30}$ |

and the balance of the alloy is essentially iron except for incidental impurities which can comprise: up to about 0.04 w/o, preferably no more than about 0.03 w/o, phosphorous; up to about 0.03 w/o, preferably no more than about 0.01 w/o, sulfur; up to about 0.5 w/o, preferably no more than about 0.2 w/o, tungsten; up to about 0.5 w/o, preferably no more than about 0.2 w/o, vanadium; up to about 0.1 w/o columbium; up to about 0.7 w/o, preferably no more than about 0.3 w/o, cobalt; and up to about 0.1 w/o of elements such as aluminum, magnesium and titanium and up to about 0.1 w/o of misch metal which can be used in refining the alloy.

In the foregoing tabulation, it is not intended to restrict the preferred ranges of the elements of the alloy of the article of this invention for use solely in combination with each other, or to restrict the particularly preferred ranges of the elements of the alloy for use solely in combination with each other, or to restrict the quite particularly preferred ranges of the elements of the alloy for use solely in combination with each other. Thus, one or more of the preferred ranges can be used with one or more of the broad ranges for the remaining elements and/or with one or more of the particularly preferred ranges for the remaining elements and/or with one or more of the quite particularly preferred ranges for the remaining elements. In addition, a preferred range limit for an element can be used with a broad range limit or with a particularly preferred range limit or with a quite particularly preferred range limit for that element.

DETAILED DESCRIPTION OF THE INVENTION

In the austenitic, non-magnetic, stainless steel alloy of the large, warm worked article of this invention, no more than about 0.1 w/o carbon is utilized. Although carbon is a strong austenite former and contributes to tensile and yield strength, it is preferred that carbon be kept to a minimum to minimize the precipitation of chromium-rich carbonitrides or carbides (e.g., $M_{23}C_6$) at grain boundaries when the alloy is heated. Preferably, no more than about 0.07 w/o carbon, particularly no more than about 0.02 w/o carbon (e.g., down to about 0.001 to 0.005 w/o carbon), is utilized. Thereby, the susceptibility of the article of this invention to corrosion, initiated at precipitates in grain boundaries, is reduced. In this regard, the use of the particularly preferred 0.02 w/o Max. carbon, together with the preferred ranges of manganese, silicon, and nickel and the preferred limits for nitrogen and (3Mo+Cr), enhances the chloride pitting resistance of the article so that it does not undergo a weight loss due to chloride pitting of more than about 5 mg/cm$^2$ when tested according to ASTM G48-76 (i.e., in 10 w/o $FeCl_3.6H_2O$ at 25 C. for 72 hours). About 0.01 w/o carbon is considered a practical and hence preferred, but not as essential, minimum because of the cost of reducing the carbon below about 0.01 w/o.

Manganese works to increase the solubility of nitrogen in the alloy of the article of this invention and is used to ensure the retention of nitrogen in solid solution despite the fact that some of the nitrogen is required to offset certain adverse effects of manganese on the corrosion resistance of the article. Manganese also acts as a scavenger for unwanted elements (e.g., sulfur) and enhances somewhat the hot workability of the alloy. For these reasons, the alloy contains at least about 1 w/o, preferably at least about 3.0 w/o, particularly at least about 3.5 w/o, quite particularly at least about 4.0 w/o, manganese. However, manangese can promote the formation of sigma phase which: (a) if present in the alloy, makes the alloy hard and brittle and thereby makes it difficult to warm work the alloy to provide the article of this invention with a 0.2% yield strength of at least about 90 ksi (about 620 MPa), preferably at least about 110 ksi (about 760 MPa); and (b) if present in the article, makes the article prone to corrosion, particularly chloride pitting, and reduces the mechanical properties of the article such as its impact strength and tensile ductility. For this reason, the alloy contains no more than about 11 w/o, preferably no more than about 9.0 w/o, particularly no more than about 7.5 w/o, quite particularly no more than about 6.0 w/o, manganese.

Silicon acts as a deoxidizing agent. However, silicon is a ferrite former and also promotes the formation of sigma phase. Hence, only up to about 0.6 w/o silicon, preferably no more than about 0.5 w/o silicon, is present in the alloy of the article of this invention.

Chromium provides significant corrosion resistance to the article of this invention. In this regard, chromium provides significant resistant to general and intergranular corrosion and to chloride pitting and crevice corrosion. Chromium also increases the solubility of nitrogen in the alloy of the article. For this reason, the alloy preferably contains at least about 18 w/o chromium. However, chromium is a ferrite former and also promotes the formation of sigma phase. For these reasons, the alloy preferably contains no more than about 23 w/o chromium alloy. The use of about 19.0 to 22.0 w/o chromium is preferably preferred, and the use of about 19.5 to 21.0 w/o chromium is quite particularly preferred.

In the article of this invention, molybdenum provides significant corrosion resistance, particularly chloride pitting resistance, crevice corrosion resistance and stress corrosion cracking resistance in environments containing sodium chloride. It is believed that molybdenum also increases the solubility of nitrogen in the alloy of the article. For these reasons, the alloy preferably contains at least about 2.5 w/o, particularly at least about 4.8 w/o, quite particularly at least about 5.0 w/o, molybdenum. However, molybdenum is a ferrite former and alos promotes the formation of sigma phase. For these reasons, the alloy preferably contains no more than about 6.5 w/o, particularly no more than about 6.0 w/o, quite particularly no more than about 5.6 w/o, molybdenum.

In the alloy of the article of this invention, it is preferred that $3Mo+Cr \geqq 29.5$, and it is particularly preferred that $3Mo+Cr \geqq 35.0$. Thereby, the alloy will contain enough chromium and molybdenum to assure that the article of this invention has a chloride pitting resistance such that the article does not undergo a weight loss due to chloride pitting of more than about 20 mg/cm$^2$, preferably no more than about 10 mg/cm$^2$, when tested according to ASTM G-48-76 (in 10 w/o $FeCl_3.6H_2O$ at 25 C. for 72 hours).

Nickel is a strong austenite former and inhibits the formation of sigma phase. Nickel also provides general corrosion resistance in environments containing acids, such as sulfuric acid and hydrochloric acid, and imparts resistance to stress corrosion cracking in chloride-containing environments. For these reasons, the alloy of the article of this invention contains at least about 14 w/o, preferably at least about 15 w/o, particularly at least about 16.0 w/o, quite particularly at least about 17.0 w/o, nickel. However, nickel is relatively expensive. Nickel can also decrease the solubility of nitrogen in the alloy. Moreover, most of the corrosion resistance benefits, obtained by adding nickel, can be attained with up to about 25 w/o nickel in the article of this invention. For these reasons, the alloy of the article contains no more than about 25 w/o, preferably no more than about 22 w/o, particularly no more than about 21.0 w/o, quite particularly no more than about 20.0 w/o, nickel.

Copper, if added to the alloy of the article of this invention, can provide significant corrosion resistance, particularly resistance to general corrosion in environments containing acids such as sulfuric acid. Copper is also an austenite former. However, most of the benefit from adding copper can be attained with up to about 2 w/o copper in the article of this invention, and more than about 1 w/o copper can adversely affect chloride pitting resistance. For these reasons and to minimize the cost of the article, copper is limited to about 2 w/o maximum, preferably about 1 w/o maximum.

Nitrogen is a strong austenite former and contributes to the tensile strength, fatigue strength, yield strength and chloride pitting resistance of the article of this invention. Nitrogen also inhibits the formation of sigma phase. For these reasons, nitrogen can be present in the alloy of the article up to its limit of solubility, which may be up to about 0.45 w/o or even higher (e.g., up to about 0.6 w/o). However, high levels of nitrogen tend to make the alloy stiffer and therefore more difficult to warm work. In accordance with this invention, the alloy contains at least about 0.15 w/o, preferably at least about 0.20 w/o, particularly at least about 0.25 w/o, quite particularly at least about 0.30 w/o, nitrogen.

Up to about 0.01 w/o boron can be present in the alloy of the article of this invention. In this regard, a small but effective amount (e.g., 0.0005 w/o or more) of boron can be used because it is believed to have a beneficial effect on corrosion resistance, as well as hot workability.

Small amounts of one or more other elements can also be present in the alloy of the article of this invention because of their beneficial effect in refining (e.g., deoxidizing and/or desulfurizing) the melt. For example, elements such as magnesium, aluminum and/or titanium, in addition to silicon, can be added to the melt to aid in deoxidizing and also to benefit hot workability as measured by high temperature ductility. When added, the amounts of such elements should be adjusted so that the amounts retained in the alloy do not undesirably affect corrosion resistance or other desired properties of the article. Misch metal (a mixture of rare earths primarily comprising cerium and lanthanum) can also be added to the melt for, inter alia, removing sulfur, and its use is believed to have a beneficial effect upon hot workability. However, for that effect, no definite amount of misch metal need be retained in the alloy because its beneficial effect is provided during the melting process when, if used, up to about 0.4 w/o, preferably no more than about 0.3 w/o, is added.

In the alloy of the article of this invention, the austenite forming elements (i.e., carbon, nitrogen and nickel) must be balanced with the sigma phase forming elements (i.e., silicon, manganese, chromium and molybdenum) according to the following equation:

$$C + N \geqq \frac{Cr + Mo + 1.5Si + 0.87Mn - Ni - 6.1}{30} \qquad \text{I}$$

In combination with appropriate conventional alloy processing (e.g., consumable electrode remelting such as electroslag remelting, followed by homogenizing at about 2200–2300 F. [about 1205–1260 C.] and then forging from about 2200–2300 F.), this balance (I) of elements ensures that sigma phase will have no significant adverse effect on the subsequent warm working of the alloy or the corrosion resistance and mechanical properties of the article. Preferably, the elements are balanced according to the following equation:

$$C + N \geqq \frac{Cr + Mo + 1.5Si + 0.87Mn - Ni - 4.3}{30} \qquad \text{II}$$

so that a significantly reduced amount and/or degree of alloy processing (e.g., consumable electrode remelting followed by just forging from about 2200–2300 F. [about 1205–1260 C.]) can be used to ensure that sigma phase will not have a significant adverse effect on the subsequent warm working of the alloy or the corrosion resistance and mechanical properties of the article. It is particularly preferred that the elements be balanced according to the following equation:

$$C + N \geqq \frac{Cr + Mo + 1.5Si + 0.87Mn - Ni - 2.7}{30} \qquad \text{III}$$

so that even a smaller amount and/or degree of alloy processing (e.g., consumable electrode remelting followed by just homogenizing at about 2200–2300 F. [about 1205–1260 C.]) can be used to ensure that sigma phase will not have a significant adverse effect on the subsequent warm working of the alloy or the corrosion resistance and mechanical properties of the article. It is quite particularly preferred that the elements be balanced according to the following equation:

$$C + N \geqq \frac{Cr + Mo + 1.5Si + 0.87Mn - Ni - 1.4}{30} \qquad \text{IV}$$

so that a minimum amount and degree of alloy processing (e.g., just consumable electrode remelting) can be used to ensure that sigma phase will not have a significant adverse effect on the subsequent warm working of the alloy or the corrosion resistance and mechanical properties of the article.

No special techniques are required in melting, casting and working the alloy of the article of this invention. In general, arc melting with argon-oxygen decarburization is preferred, but other practices can be used. The initial ingot is preferably cast as an electrode and remelted (e.g., by vacuum arc remelting or electroslag remelting) to minimize sigma phase formation and enhance the homogeneity of the cast alloy. Powder metallurgy techniques can also be used to provide better control of unwanted constituents or phases in the alloy. The alloy can be homogenized at about 2100–2300 F. (about 1150–1260 C.), preferably about 2200–2300 F. (about 1205–1260 C.). The alloy can be hot worked from a furnace temperature of about 2050–2300 F. (about 1120–1260 C.), preferably about 2200–2300 F. (about 1205–1260 C.), with reheating as necessary. Process annealing can be carried out at about 1900–2200 F. (about 1040–1205 C.), preferably about 2100–2200 F. (about 1150–1205 C.), for a time depending upon the dimensions of the article. Warm working can be carried out between about 1500 and 2200 F. (between about 815 and 1205 C.), preferably by means of rotary forging. In accordance with this invention, the alloy is significantly warm worked at a temperature of about 1500–1650 F. (about 815–900 C.), regardless of any previous homogenizing, hot working, annealing or warm working of the alloy above about 1650 F. (about 900 C.). After warm working, the alloy is preferably liquid (e.g., water) quenched to minimize the chances of forming sigma phase or carbide or carbonitride precipitates. Following this liquid quenching, the alloy can be heated at about 1700–1900 F. (about 925–1040 C.) and then liquid quenched again to reduce strain and to dissolve carbide or carbonitride precipitates formed during warm working, provided the 0.2% yield strength is not thereby reduced below about 90 ksi.

The alloy of the article of this invention can be formed with a great variety of shapes and for a wide variety of uses. The article lends itself to the formation of billets, bars, rod, wire, strip, plate or sheet using conventional practices. However, as indicated above, the article is particularly suited to be formed into a warm worked article such, as a drill collar or an MWD assembly housing, having a large section size (i.e., about 5 inches [about 12.7 cm] in diameter or larger).

EXAMPLES

Examples of alloys which can be used in the large, warm worked article of this invention are set forth in Table I, below.

TABLE I

| Examples | Elements* (w/o) | | | | | | | | |
|---|---|---|---|---|---|---|---|---|---|
| | C | Mn | Si | Cr | Ni | Mo | N | B | Fe |
| 1 | .034 | 4.88 | 0.27 | 20.22 | 17.76 | 5.14 | 0.36 | .0025 | Bal. |
| 2 | .015 | 4.87 | 0.39 | 20.04 | 17.62 | 5.16 | 0.34 | .0026 | Bal. |
| 3 | .025 | 4.95 | 0.47 | 20.35 | 17.68 | 5.25 | 0.34 | .0029 | Bal. |
| 4 | .040 | 4.86 | 0.33 | 20.08 | 17.90 | 5.11 | 0.37 | .0031 | Bal. |

*P is no more than .03 w/o, S is no more than .01 w/o, Cu is no more than 0.3 w/o, Co is no more than 0.7 w/o, Cb is no more than 0.1 w/o, W is no more than 0.2 w/o, V is no more than 0.2 w/o and Al, Mg and Ti are no more than 0.1 w/o.

Heats of examples 1 and 2 were arc melted, then argonoxygen decarburized, then electroslag remelted, and then forged from 2200 F. (1205 C.) and 2050 F. (1120 C.), respectively. 2×5×1 inch (5.1×12.7×2.5 cm) specimens were cut from each heat, and some of these specimens were homogenized at 2300 F. (1260 C.) for 60 minutes, water quenched, warm worked by rolling from 1800 F. (980 C.) down to about 1500 F. (about 815 C.) and then air cooled. The resulting, about 2×8×0.625 inch (about 5×20×1.6 cm) specimens were sensitized at 1250 F. (675 C.) for one hour and then air cooled so that the specimens simulated articles having large section sizes (i.e., about 5 inches [about 12.7 cm] in diameter or larger). The yield strength of each specimen was measured according to ASTM E8-81. The results are set forth in Table II, below.

TABLE II

| Examples | 0.2% Yield Strength (ksi) | (MPa) |
|---|---|---|
| 1 | 114.3 | 788.1 |
| 2 | 107.6 | 741.9 |

Some of the 2×5×1 inch (5.1×12.7×2.5 cm) specimens were hot worked by rolling from 2300 F. (1260 C.). The resulting, about 2×18×0.28 inch (about 5×46×0.71 cm) specimens were then annealed at 2150 F. (1175 C.) for 30 minutes, water quenched, warm worked by rolling from 1800 F. (980 C.) down to about 1500 F. (815 C.) and then air cooled. The resulting, about 2×35×0.14 inch (about 5×89×0.36 cm) specimens were sensitized at 1250 F. (675 C.) for 1 hour and then air cooled. The chloride pitting resistance of each specimen was measured according to ASTM G48-76 in 10 w/o $FeCl_3.6H_2O$ at 25 C. for 72 hours. The results are set forth in Table III, below.

TABLE III

| Examples | Pitting ($mg/cm^2$) | |
|---|---|---|
| 1 | 20.6 | 20.8 |
| 2 | 3.1 | 4.4 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. An austenitic, non-magnetic, stainless steel alloy consisting essentially in weight percent (w/o) of about:

| Elements | w/o |
|---|---|
| C | .02 Max. |
| Mn | 3.0–9.0 |
| Si | 0.5 Max. |
| Cr | 18–23 |
| Ni | 15–22 |
| Mo | 4.8–6.5 |
| Cu | 2 Max. |
| B | .01 Max. |

N ranging from a minimum of about 0.20 w/o to no more than the amount that can be retained in solid solution; 3Mo+Cr being equal to at least 29.5; C+N being equal to at least about:

$$\frac{Cr + Mo + 1.5\,Si + 0.87\,Mn - Ni - 6.1}{30}$$

and the balance being essentially iron so that a large section size of the alloy, that has been significantly warm worked between about 1500 F. and 1650 F. but not subsequently annealed, has a 0.2% yield strength of at least about 90 ksi and, when formed into a U-bend, does not undergo stress corrosion cracking within about 700 hours in boiling saturated aqueous sodium chloride containing 2 w/o ammonium bisulfite.

2. The alloy of claim 1 wherein $$C + N \geqq \frac{Cr + Mo + 1.5\,Si + 0.87\,Mn - Ni - 4.3}{30}.$$

3. The alloy of claim 1 which contains about:

| Elements | w/o |
|---|---|
| Mn | 3.5–7.5 |
| Cr | 19.0–22.0 |
| Ni | 16.0–21.0 |
| Mo | 4.8–6.0. |

4. The alloy of claim 3 wherein N is at least about 0.25 w/o.

5. The alloy of claim 4 wherein $$C + N \geqq \frac{Cr + Mo + 1.5\,Si + 0.87\,Mn - Ni - 4.3}{30}.$$

6. The alloy of claim 4 wherein $$C + N \geqq \frac{Cr + Mo + 1.5\,Si + 0.87\,Mn - Ni - 2.7}{30}.$$

7. The alloy of claim 6 wherein 3Mo+Cr≧35.0.

8. The alloy of claim 1 which contains about:

| Elements | w/o |
|---|---|
| Mn | 4.0–6.0 |
| Cr | 19.5–21.0 |
| Ni | 17.0–20.0 |
| Mo | 5.0–5.6. |

9. The alloy of claim 8 wherein N is at least about 0.30 w/o.

10. The alloy of claim 9 wherein $$C + N \geqq \frac{Cr + Mo + 1.5\ Si + 0.87\ Mn - Ni - 4.3}{30}.$$

11. The alloy of claim 9 wherein $$C + N \geqq \frac{Cr + Mo + 1.5\ Si + 0.87\ Mn - Ni - 2.7}{30}.$$

12. The alloy of claim 11 wherein $$3Mo + Cr \geqq 35.0$$

13. The alloy of claim 12 wherein $$C + N \geqq \frac{Cr + Mo + 1.5Si + 0.87Mn - Ni - 1.4}{30}.$$

* * * * *